United States Patent [19]

Lendl et al.

[11] 4,313,681

[45] Feb. 2, 1982

[54] TYPE DISC POSITIONING MECHANISM

[75] Inventors: Josef Lendl, Ottensoos; Diethelm Puch, Nuremberg, both of Fed. Rep. of Germany

[73] Assignee: Triumph-Werke Nurnberg A.G., Nuremberg, Fed. Rep. of Germany

[21] Appl. No.: 145,749

[22] Filed: May 1, 1980

[30] Foreign Application Priority Data

Apr. 5, 1979 [DE] Fed. Rep. of Germany ..... 2918026

[51] Int. Cl.[3] ..... B41J 1/30

[52] U.S. Cl. ..... 400/144.2; 400/161.5

[58] Field of Search ..... 400/144.1, 144.3, 161.5, 400/162.1, 164.2, 372, 373; 101/93.19

[56] References Cited

U.S. PATENT DOCUMENTS

| | | | |
|---|---|---|---|
| 1,189,449 | 7/1916 | Highley | 400/144.2 |
| 2,161,840 | 6/1939 | Adams | 400/144.2 X |
| 3,677,384 | 7/1972 | Link | 400/161.5 |
| 4,106,611 | 8/1978 | Suzuki et al. | 400/144.2 |
| 4,239,400 | 12/1980 | Giolitti | 400/144.2 |

FOREIGN PATENT DOCUMENTS

| | | | |
|---|---|---|---|
| 2710427 | 9/1978 | Fed. Rep. of Germany | 400/144.2 |
| 604982 | 5/1960 | Italy | 400/144.2 |

*Primary Examiner*—Paul T. Sewell

[57] ABSTRACT

Mechanism responsive to discrete character signals is provided for selectively rotatably positioning a type disc clockwise or counterclockwise from a home position to present the selected character on the type disc for printing. The mechanism comprises a driven lever pivoted intermediate its ends which is cycled about its pivot in response to each character selector signal from a keyboard. When cycled, one of the arms of the driven lever is adapted to drive an associated rocker from a rest position and through its other arm is adapted to allow an associated rocker to be driven from a rest position. The movement of the rockers, the magnitude of which is determined by interposers representative of characters which are selectively interposed between associated arms and rockers at various distances from the pivot of the driven lever, controls the pivotal movement of associated frame supported crank levers spring urged against the rockers. The crank levers carry pulleys about which a cable is trained with one end of the cable secured to a frame part and the other to a spring drum on the type disc shaft thereby to rotate the type disc clockwise or counterclockwise according to which of the crank levers is pivoted and to a position corresponding to the angle of pivoting thereof.

6 Claims, 5 Drawing Figures

Fig_4
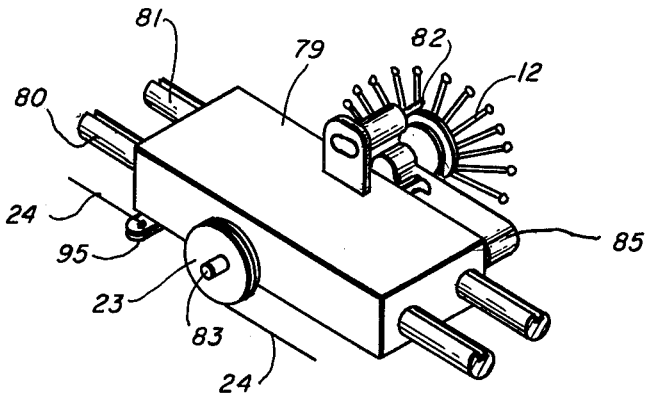
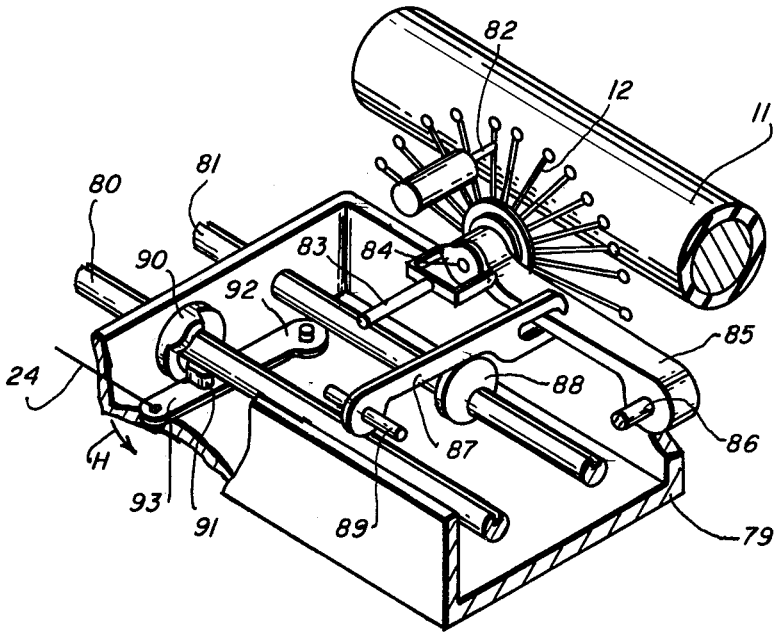
Fig_5

TYPE DISC POSITIONING MECHANISM

This invention relates to type disc positioning mechanism; more particularly it relates to type disc positioning mechanism having key selected interposers located to be positionable between a cyclically driven lever and associated type disc positioning rocker means at various distances from the pivot of the driven lever thereby to control the magnitude of movement of the rocker means and rotation of the type disc; and specifically to type disc positioning means wherein the cyclically driven lever is pivoted intermediate its ends and wherein each arm thereof is associated with type disc positioning rocker means for selectively rotating said type disc clockwise and counterclockwise from a home position.

Positioning devices characterized by driven levers acting on a crank lever through selectable stops located along the length of driven levers have been employed to rotate a printing element as disclosed in U.S. Pat. No. 3,677,384. As the printing element in said patent is a ball which is rotatable to select a column and tiltable to select a row of characters, only a limited number of rotational steps need be provided to select a coordinate location on the ball. On the other hand a type disc printing element has all the characters arranged around the periphery thereof, usually 44 lower case and 44 upper case characters, requiring at least 44 rotational steps to select all the characters in a particular case. Thus the teaching of said patent does not lend itself, without undue complexity, cost, and size, to rotatably positioning a type disc.

In accordance with the invention a positioning mechanism capable of rotationally positioning a type disc is provided and is characterized by key selected and actuated interposers corresponding in number to the keys on a typewriter keyboard. The interposers are movable between a cyclically driven two armed lever and type disc rotating means to control, according to their positions relative to the driven lever pivot, the magnitude of motion transmitted to the type disc rotating means. The type disc rotating means take the form of crank levers which support pulleys about which a cable is trained and connected at one end to a frame part and at the other end to a spring drum connected to rotate the type disc. The crank levers are urged by the spring drum against associated end to end rocker bars held in home positions. When cycled one or the other of the arms of the driven lever will, according to the location of a selected interposer, either drive or allow an associated rocker bar to be driven thereby to pivot its associated crank lever.

An object of the invention is to provide a low cost reliable type disc positioning mechanism.

Other objects and many of the attendant advantages of this invention will be readily appreciated as the same becomes better understood by reference to the following detailed description when considered in connection with the accompanying drawing wherein;

FIG. 4 is a perspective view of a type disc supported on a movable carriage; and FIG. 5 is a view similar to FIG. 4 with carriage parts broken away.

Figure 1:
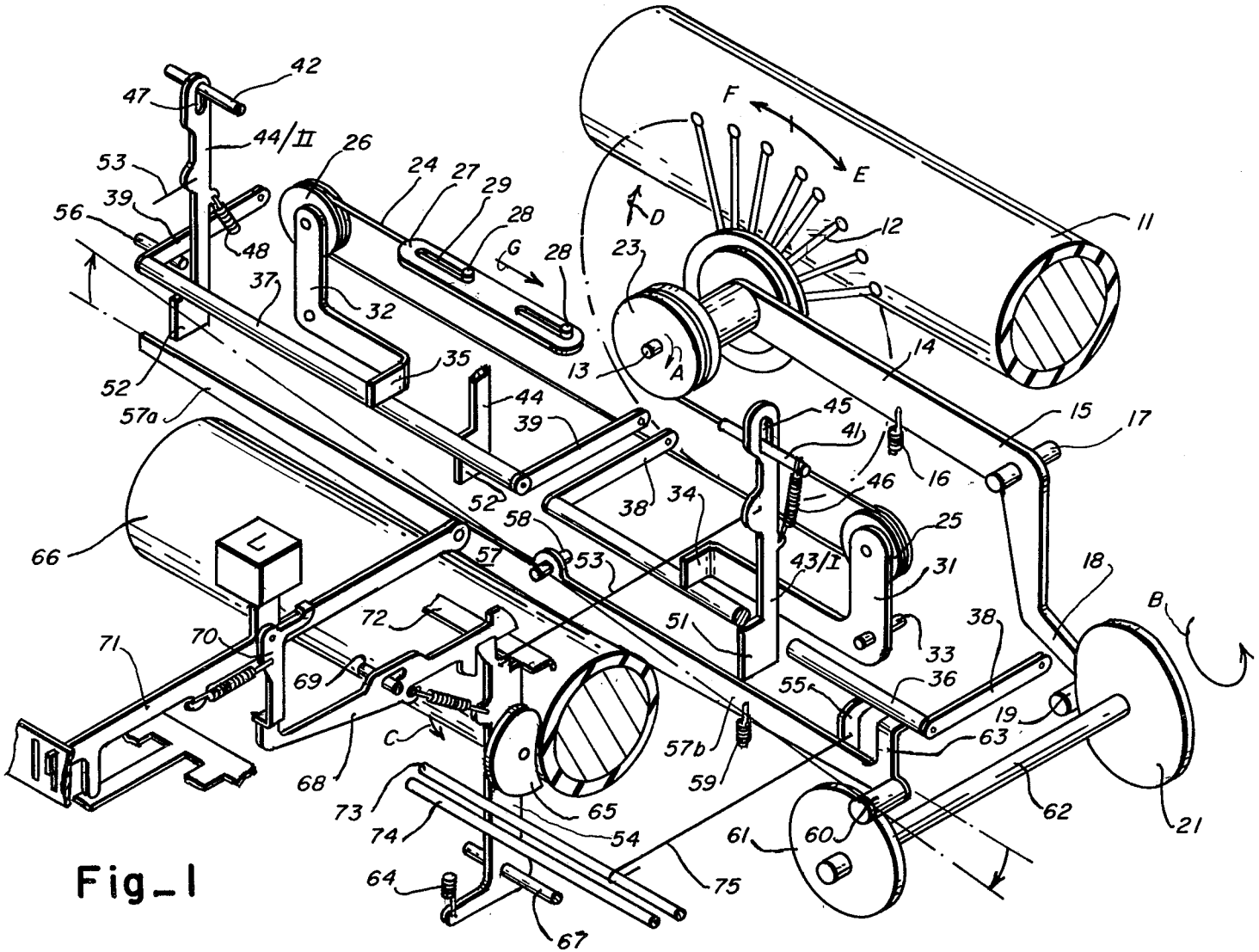
FIG. 1 is a perspective view of a type disc positioning mechanism in accordance with the invention.

Referring now to the drawing there is shown in FIG. 1, a platen 11 supported on a movable carriage (not shown). A type disc 12 having a plurality of character bearing spokes is secured to a shaft 13 which is rotatably carried on an arm 14 of a pivot lever 15. The pivot lever 15 is loaded by a spring 16 and pivots about a frame supported pin 17. The other arm 18 of the pivot lever 15 supports a follower roller 19 which is held in contact with a rotary eccentric cam 21 by the spring 16 connected to the pivot lever arm 14 and to a frame member.

Disposed about the shaft 13 of the type disc 12 is a spring drum 23 inside of which is a coiled spring whose ends are connected to the drum 23 and to the shaft 13. The coiled spring normally biases the spring drum 23 and shaft 13 clockwise in a direction designated A. A cable 24 is fastened at one end to the spring drum 23 from whence it is trained about pulleys 25 and 26 and connected at its other end to a frame supported part 27 which is movable relative to frame supported pins 28 extending into elongated holes 29 in the slide.

Pulleys 25 and 26 are rotatably mounted on crank levers 31 and 32 pivoted at opposite sides of the machine frame on pins 33. The crank levers 31 and 32 have bent out portions 34 and 35 respectively which bear against rocker bars 36 and 37 which are mounted on the ends of arms 38 and 39 pivoted to the machine frame. Rocker bars 36 and 37 are aligned and extend from the right and left sides of the machine to the machine center.

Also provided in the machine frame are two mounting rods 41 and 42, on which are mounted selectable interposers 43, 44 divided into two groups designated I and II. The required number of interposers 43, 44 corresponds to half the number of character spokes of the type disc 12. By means of elongated holes 45 the interposers 43 are mounted on the mounting rod 41 so as to be pivotable and movable lengthwise. They are loaded by a spring 46 tending to pull the interposers 43 upwardly.

By means of elongated holes 47 the interposers 44 are also mounted on the mounting rod 42 so as to be pivotable and movable lengthwise. They, too, are loaded by a spring 48 which, however, tends to pull the interposers 44 downwardly. A tab 51, 52 is provided at the free end of each of the interposers 43, 44, respectively. In addition, pull wires 53 leading to cam supporting levers 54 of the keyboard are hooked into the interposers 43, 44.

The rocker bar 36 is releaseably retained in a basic position against counterclockwise movement by a latch lever 55. The rocker bar 37 is similarly locked against counterclockwise movement by a fixed downstop 56. Thus the rocker bars 36 and 37 limit the clockwise and counterclockwise movement of crank levers 31 and 32 by the spring drum 23 to a lower case home position.

A driven lever 57 is so disposed underneath the tabs 51 and 52 of the interposers 43 and 44 that it can pivot about its central shaft 58. Driven lever 57 is loaded by a spring 59 tending to keep a follower roller 60 provided at one end in constant contact with an eccentric cam 61 mounted, together with the eccentric cam 21, on a common shaft 62. In addition, on the side on which the follower roller 60 is located, the driven lever 57 has upwardly directed bent out extension 63 which also normally underlies the rocker bar 36.

The cam supporting levers 54 are loaded by springs 64 and support cams 65 which can be caused to contact a constantly revolving power roll 66. The levers 54 are mounted on a common pivot shaft 67 and interact with control levers 68 mounted on a shaft 69 so as to be pivotable and movable lengthwise. The control levers 68 can be actuated by means of a release pawl 70 pivotably mounted on the key levers 71. Further details of the keyboard input mechanism including the operation of a locking bar 72 and how the simultaneous initiation of more than one setting operation is prevented, may be had by reference to U.S. Pat. No. 3,882,987.

Figure 2:
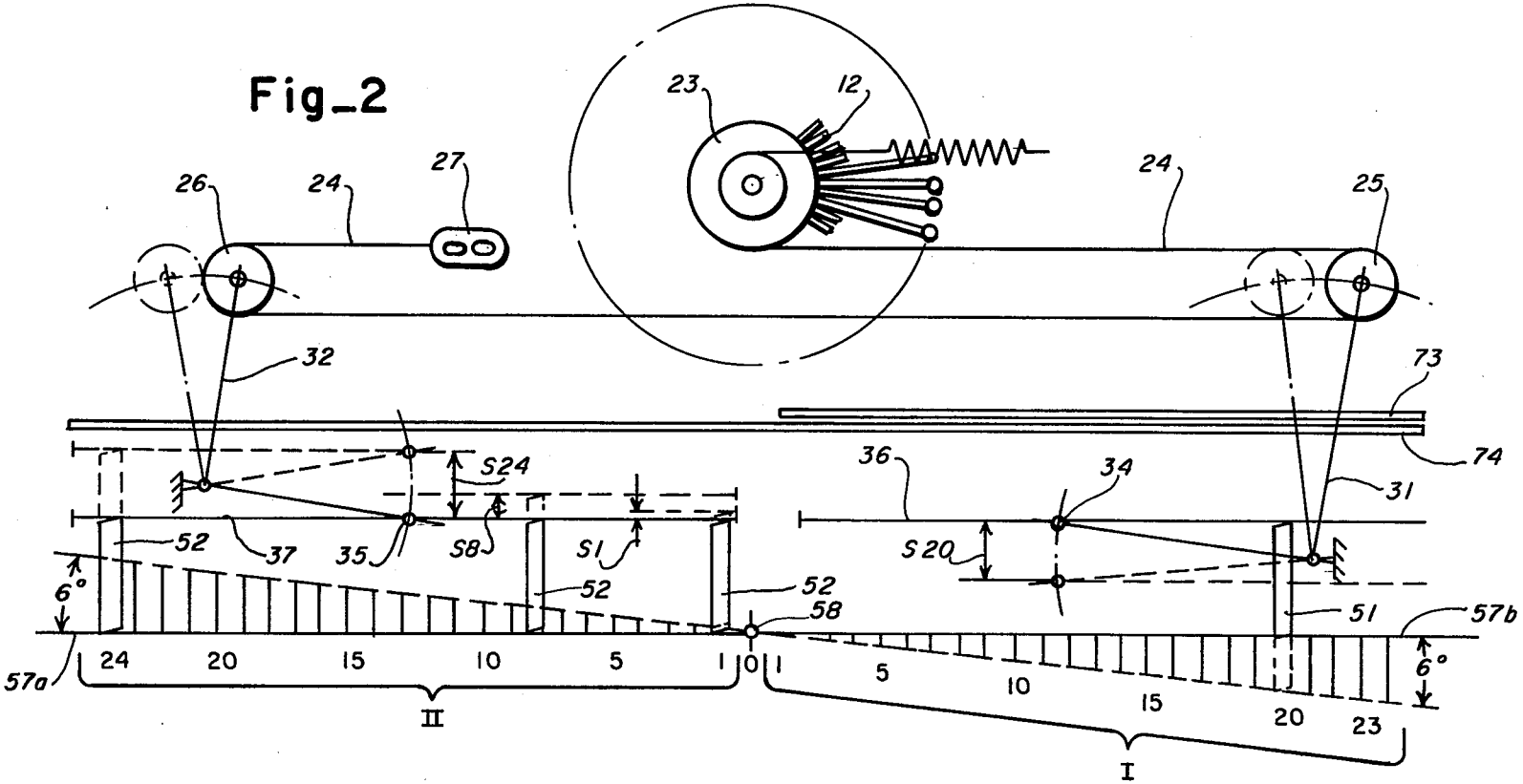
FIG. 2 is a diagramatic view illustrating the positioning concept.

As shown in FIGS. 1 and 2 a latch release bar 73 and a clutch release bar 74 are disposed within the pivot range of the levers 54. The latch release bar 73 is assigned only to the levers 54 of group I of the interposers 43, being connected to the latch lever 55 by means of a pull wire 75. This means that when a lever 54 associated with the interposers 43 of group I is actuated, the release bar 73 pivots and pulls the latch lever 55 out from under the rocker bar 36.

The clutch release bar 74 extends over the entire width of the keyboard and is thus assigned to every lever 54, regardless of whether the latter is associated with the interposers 43, 44 of group I or II. Upon the actuation of clutch release bar 74 by a driven lever 54 a cycle clutch (not shown) is engaged to couple an electric motor (not shown) and the shaft 62 of the cams 21 and 61. Upon the engagement of the clutch the shaft 62 with the cams 21 and 61 rotates in the direction designated by arrow B.

OPERATION

Figure 3:
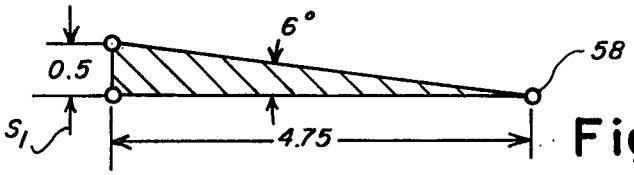
FIG. 3 is a diagramatic view of a portion of FIG. 2 to larger scale.

Referring to FIGS. 1–3, it is pointed out first that the type disc 12 returns into a predetermined basic or home position after typing each character. One type of the disc 12 is positioned in this basic position. Accordingly, the basic position is coordinated with the central key lever 71 of a keyboard. Therefore, neither an interposer 43 of group I nor an interposer 44 of group II is selected by key lever 71. Nor does its associated powered lever 54 act upon the release bar 73. So, when this central key lever 71 is actuated, its associated lever 54 is pivoted in the direction designated by arrow C, as described in said U.S. Pat. No. 3,882,987. This motion is transmitted to the clutch release bar 74 which couples shaft 62 via a one revolution clutch to the motor. This causes the shaft 62 with the eccentric cams 21 and 61 to revolve once by 360°. This causes the driven lever 57 under the action of spring 59 to perform a clockwise pivoting motion, as shown in FIG. 1. This pivoting motion, however, as no interposer 43 or 44 is selected has no effect on either rocker bar 36 or 37 or associated crank levers 31, 32. Thus rocker bars 36 and 37 remain in their rest positions established by the latch lever 55 and downstop 56, notwithstanding the extension 63 has dipped away. Accordingly, the type disc 12 also remains in its basic position. It is merely lifted by the eccentric cam 21 and the pivot lever 15 in the direction designated by arrow D to present the type opposite the printing line of the platen 11. Once this position is reached, the type is caused to impact by means of a hammer in known manner. As the shaft 62 continues turning, the cams 21 and 61 and, hence, the pivot lever 15 and the driven lever 57 return into their basic positions. The type disc 12 is then lowered again, clearing the view of the typed line and the cycle clutch or one revolution clutch, disengages the drive of shaft 62.

When a key lever 71 associated with an interposer 43 in group I is selected its associated lever 54 is pivoted in the direction designated by arrow C by means of the power roll 66 and cam 65. This motion causes the pull wire 53 to rock its associated interposer 43 and position its tab 51 under the rocker bar 36 and between this rocker bar 36 and the arm **57*b* of the driven lever 57. At the same time, via release bar 73 and pull wire 75 the latch lever 55 is pulled out from under the rocker bar 36**.

As already described, the clutch release bar 74 acts upon the main clutch so that the shaft 62 with the cams 21 and 61 starts turning counterclockwise. The follower roll 60 on the driven lever 57 follows the circumferential track of the eccentric 61 so that the extension 63 also dips away from under the rocker bar 36. This enables the bent portion 34 of the crank lever 31 to follow the rocker bar 36 and pivot counterclockwise under the action of the spring in the spring drum 23. In so doing, the spring drum takes up cable 24 and turns the type disc 12 in the direction designated by arrow E as far as the rocker bar 36 permits.

Simultaneous with the positioning of the type disc 12 the pivot lever 15 pivots in arrow direction D so that the type selected is raised to the typing line. After impact by means of an aforementioned hammer, all moved parts return into their basic position; pivot lever 15 through the agency of cam 21, and the type disc 12, the crank lever 31 and the rocker bar 36 through the action of cam 61 on the driven lever 57 whose extension 63 restores rocker bar 36 to its rest position. The latch lever 55 also is again positioned under the rocker bar 36 securing it in its basic position. The selected interposer 43 driven by motion of the rocker bar 36 in its elongated hole 45, is restored upwardly by the spring 46 and pivoted back so that the tab 51 moves out of the space between the driven lever 57 and the rocker bar 36.

When a key lever assigned to an interposer 44 of group II is actuated, the interposer 44 selected is pivoted via a pull wire 53 so that its tab 52 is moved between the rocker bar 37 and the arm **57*a* of the driven lever 57. Since the release bar 73 is not associated with the levers 54 of group II interposers 44, the latch lever 55 is not actuated. Therefore, rocker bar 36** remains in rest position.

The clutch release bar 74 is however actuated in the above described manner so that the shaft 62 with the cams 21 and 61 starts turning via the main clutch. This again causes the type disc 12 to be raised by the pivot arm 15 and driven lever 57 to be cycled. During the clockwise pivoting motion of the driven lever 57 its arm **57*a* now pushes against tab 52 of the selected interposer 44 which in turn pushes rocker bar 37 upwardly or clockwise. Because of its elongated hole 47 the interposer 44 can follow this motion. Since the bent portion 35 of the crank lever 32 rests on the rocker bar 37, the crank lever 32 is pivoted counterclockwise. This exerts a pull on the cable 24 so that the spring drum 23 and the type disc 12** turn in the direction designated by arrow F, opposite to arrow E. After the character has been typed, the parts just described return again into their basic position also.

With particular reference to FIG. 2 there is illustrated how different angles of rotation of the type disc 12 from its basic position are accomplished. With every actuation, the driven lever 57 performs a clockwise pivoting motion of 6°.

At a 47.5 mm mutual spacing of the interposers 43, the resultant angular travel from the pivot 58 of the driven lever 57 to the interposer tab 52 at position 1 is e.g. 0.5 mm (FIG. 3). An additional angular travel of 0.5 mm is added from position to position so that in position 23, for instance, an angular travel of 11.5 mm is reached.

In FIG. 2 a tab 51 of an interposer of group I is shown selected at position 20. This releases latch lever 55 and rocker bar 36. Thus when the arm 57*b* of the driven lever 57 is moved clockwise out of its basic position to its lower limit, the crank lever 31 whose bent portion 34 presses against the rocker bar 36, due to the action of the spring in the spring drive 23, pushes the rocker bar 36 down. The rocker bar 36 in turn pushes against the upper edge of interposer tab 51 whose lower edge follows the arm 57*b*. Accordingly, the position of the tab 51 relative to the pivot 58 of the driven lever 57 determines the angle S which the crank lever 31 with its pulley 25 travels counterclockwise. In the case described above this is the angular travel designated S-20.

If an interposer 44 of group II is selected, its tab 52 interacts with the arm 57*a* of the driven lever 57. In FIG. 2 this is the tab 52 of interposer 44 in position 8. The tab 52 and, hence, the rocker bar 37 are lifted by means of the driven lever 57 via its arm 57*a*. The rocker bar 37 transmits a pivoting motion to the crank lever 32, corresponding to an angular travel S-8. This causes the cable 24 to turn the spring drum 23 and rotate the type disc 12 by a defined amount in the direction opposite to arrow E.

Accordingly, in the graph of FIG. 2, 48 different positions of the type disc 12 are possible, as follows: 24 positions in one sense of rotation (group II), 23 positions in the other sense of rotation (group I), and one position according to the basic position of the type disc 12, in which no interposer is selected. The other 48 positions of the type disc 12, making a total of 96 characters, are set by actuating one of the shift keys known per se in typewriters. The actuation of such a shift key acts upon the frame supported part 27 which is moved so far in the direction of arrow G until the other ends of the elongated holes 29 rest against the pins 28. This distance corresponds to a 180° rotation of the spring drum 23 and of the type disc 12 opposite to the arrow direction A. Accordingly, another 48 positions can be set from the new or upper case basic position of the type disc 12 in collaboration with the rest of the positioning mechanism.

In order to prevent relative motions on the type disc 12 when actuating the pivot lever 15 the basic position is adjusted in the actuated position of the pivot lever 15. This prevents the motions of the pivot lever 15 and of the crank lever 31 in opposite directions from leading to faulty settings of the type disc 12.

The stepwise motion of the paper carrying carriage with the platen 11 takes place in a manner generally used in typewriters of this kind.

Referring now to FIGS. 4 and 5 the invention is shown embodied in a typewriter wherein the type disc 12 is mounted on a movable carriage while the platen 11 is fixed in the machine frame.

As shown a type body carriage 79 is mounted on rotatable guide rails 80 and 81 so as to be movable lengthwise. It is moved laterally by one character spacing after the typing of each character by means not shown. Rotatably mounted to it is the type disc 12, and a typing hammer 82 takes care that a selected character is typed. As is evident from FIG. 5, the type disc 12 is mounted on a shaft 83 which has an elastic, articulated joint coupling 84. The driven part of shaft 83 is supported by a pivot lever 85 pivotable about a pin 86 in the carriage 79. A pivoting arm 87 disposed at right angles to the pivot lever 85 rests on a cam 88. The pivoting arm 87 pivots about the pin 89 mounted in the carriage 79. The cam 88 is connected to the guide rail 81 so as to be secure against rotation, but movable lengthwise.

The guide rail 80 has a face cam 90 contacted by a pin 91 of a pivot lever 92. One end of the cable 24 is fastened to the free end 93 of the pivot lever 92. As FIG. 4 shows, the spring drum 23 in this embodiment is mounted on the shaft 83 of the type disc 12 outside of the carriage 79. Contained in the spring drum as in FIG. 1 is a spring, and the cable 24 is fastened to the outside diameter of the spring drum 23.

Everything else in the device for setting the type disc 12 is as described in FIGS. 1 to 3. The setting motions for the type disc 12 are likewise transmitted to the type disc 12 by means of the crank levers 31 and 32, the deflection pulleys 25 and 26, and the cable 23. If a shift key is depressed, the guide rail 80 is rotated by 180° by the machine's power drive by means of a half-revolution clutch. This causes the face cam 90 to push the pin 91 of the pivot lever 92 in arrow direction H, thereby exerting pull on the cable 23. This setting motion corresponds to that performed by the frame supported part 27 according to FIG. 1. The type disc 12 thus arrives in its second basic position. The rest of the setting motion for the type disc 12 conforms to what has already been explained in connection with FIGS. 1 and 2.

To raise the type disc 12 into typing position the guide rail 81 is turned also so that the cam 88 lifts the pivot arm 87 and the latter the pivot arm 85 with the type disc 12. The elastic, articulated joint coupling permits such a motion relative to the shaft 83 without problems. After the actuation of the typing plunger 82 the cam 88 resumes its initial position, and the type disc 12 is lowered.

In this arrangement, the lateral, stepwise, or continuous motion of the carriage 79 has no influence on the rotary setting of the type disc 12.

The invention claimed is:

1. A typewriter including a rotatably mounted shaft, a type disc having character supporting spokes secured to said shaft, a spring drum secured to said shaft and normally urging said shaft in one direction, a cable secured to and wound about said spring drum, a frame, first and second spaced crank levers pivotally mounted on said frame, pulleys mounted on the ends of said levers, said cable extending from said spring drum around said space pulleys and connected at its other end to a frame supported part, whereby said first crank lever is urged in a clockwise direction and said second crank lever in a counter clockwise direction by said spring drum, first and second rocker bars located in the path of said first and second crank levers, first means for limiting the rocking movement of said first rocker bar under urging by said first crank lever, second means for limiting rocking movement of said second rocker bar under urging of said second crank lever thereby establishing a home position of said type disc, a cyclically operable drive lever pivoted intermediate its ends defining first and second arms, an array of key selectable interposers arranged for movement between the arms of said cyclically operable drive lever and said first and second rocker bars, and key controlled means for moving a selected interposer between said first and second arms of said drive lever and said first and second rocker bars and for cycling said drive lever, said key controlled means including means for releasing said second means to allow movement of said second rocker bar when the interposer selected is between said second arm and said second rocker bar, said drive lever acting to drive said first rocker bar or allow movement of said second rocker bar through an angle determined by the location of a selected interposer relative to the pivot of said drive lever to cause angular movement from home position of said first and said second pulley levers and corresponding movement of said type disc to a selected position.

2. A typewriter as recited in claim 1, said type disc having twice the number of characters supporting spokes as interposers, and means to enable said frame part anchoring said cable to be shifted to rotate the type disc to an upper case home position.

3. A typewriter as recited in claim 1, said means rotatably mounting said type disc shaft comprising a pivotal lever, and cyclically operable means for pivoting said lever to raise said type disc to a typing position.

4. A typewriter as recited in claim 3, said type disc shaft and said means for pivoting said lever being mounted on a movable carriage.

5. A typewriter as recited in claim 1, said key controlled means including cam levers with cams thereon, a power roll, said cam levers being releasable to effect engagement of said cams with said power roll to drive said cam levers, and said cam levers being linked to move said selector interposers and, means responsive to movement of any cam lever for cycling said drive lever.

6. A typewriter as recited in claim 5, said last named means including an eccentric cam against which said drive lever is biased, power means, and a clutch for connecting said power means to drive said eccentric.

* * * * *